US008942410B2

(12) United States Patent
Wilk et al.

(10) Patent No.: US 8,942,410 B2
(45) Date of Patent: Jan. 27, 2015

(54) MAGNETICALLY BIASED ELECTROMAGNET FOR AUDIO APPLICATIONS

(71) Applicant: Apple Inc., Cupertino, CA (US)

(72) Inventors: Christopher R. Wilk, Sunnyvale, CA (US); Martin E. Johnson, Los Gatos, CA (US); Patrick Kessler, San Francisco, CA (US); Nathan A. Johanningsmeier, San Jose, CA (US)

(73) Assignee: Apple Inc., Cupertino, CA (US)

( * ) Notice: Subject to any disclaimer, the term of this patent is extended or adjusted under 35 U.S.C. 154(b) by 32 days.

(21) Appl. No.: 13/731,973

(22) Filed: Dec. 31, 2012

(65) Prior Publication Data

US 2014/0185859 A1 Jul. 3, 2014

(51) Int. Cl.

| | |
|---|---|
| ***H04R 1/00*** | (2006.01) |
| ***H04R 9/02*** | (2006.01) |
| *H04R 1/02* | (2006.01) |

(52) U.S. Cl.

CPC ..... *H04R 9/025* (2013.01)
USPC ..... 381/412; 381/396; 381/388

(58) Field of Classification Search

USPC ..... 381/412, 396, 388, 398, 333, 306, 400, 381/413, 421

See application file for complete search history.

(56) References Cited

U.S. PATENT DOCUMENTS

| | | | | |
|---|---|---|---|---|
| 4,081,631 | A | | 3/1978 | Feder |
| 4,658,425 | A | | 4/1987 | Julstrom |
| 5,335,011 | A | | 8/1994 | Addeo et al. |
| 5,570,324 | A | | 10/1996 | Geil |
| 5,619,583 | A | | 4/1997 | Page et al. |
| 5,649,020 | A | | 7/1997 | McClurg et al. |
| 5,894,263 | A | * | 4/1999 | Shimakawa et al. ..... 340/388.1 |
| 6,073,033 | A | | 6/2000 | Campo |
| 6,129,582 | A | | 10/2000 | Wilhite et al. |
| 6,151,401 | A | | 11/2000 | Annaratone |
| 6,154,551 | A | | 11/2000 | Frenkel |

(Continued)

FOREIGN PATENT DOCUMENTS

| | | |
|---|---|---|
| EP | 2094032 | 8/2009 |
| GB | 2310559 | 8/1997 |

(Continued)

OTHER PUBLICATIONS

International Search Report and Written Opinion, PCT/US2011/052589, (Feb. 25, 2012), 13 pages.

(Continued)

*Primary Examiner* — Curtis Kuntz
*Assistant Examiner* — Sunita Joshi
(74) *Attorney, Agent, or Firm* — Blakely, Sokoloff, Taylor & Zafman LLP

(57) ABSTRACT

An electronic device having an enclosure having a top panel and a bottom panel. An electromagnet is mounted within the enclosure, the electromagnet having a core portion attached to the top panel and a coil connected to the core portion. An attractor plate is attached to the bottom panel, the attractor plate forming part of a magnetic circuit of the electromagnet such that when an electrical audio signal is applied to the electromagnet, the bottom panel vibrates and produces a sound. A permanent magnet is further attached to the core portion, the permanent magnet is configured to create a bias in the magnetic circuit so as to modify a distortion in the sound.

20 Claims, 10 Drawing Sheets

(56) References Cited

U.S. PATENT DOCUMENTS

| | | | | |
|---|---|---|---|---|
| 6,192,253 | B1 | 2/2001 | Charlier et al. | |
| 6,278,787 | B1 | 8/2001 | Azima | |
| 6,317,237 | B1 | 11/2001 | Nakao et al. | |
| 6,324,294 | B1 | 11/2001 | Azima et al. | |
| 6,332,029 | B1 | 12/2001 | Azima et al. | |
| 6,342,831 | B1 | 1/2002 | Azima | |
| 6,618,487 | B1 | 9/2003 | Azima et al. | |
| 6,813,218 | B1 | 11/2004 | Antonelli et al. | |
| 6,829,018 | B2 | 12/2004 | Lin et al. | |
| 6,882,335 | B2 | 4/2005 | Saarinen | |
| 6,934,394 | B1 | 8/2005 | Anderson | |
| 7,003,099 | B1 | 2/2006 | Zhang et al. | |
| 7,082,322 | B2 | 7/2006 | Harano | |
| 7,154,526 | B2 | 12/2006 | Foote et al. | |
| 7,158,647 | B2 | 1/2007 | Azima et al. | |
| 7,158,651 | B2 * | 1/2007 | Bachmann et al. | 381/412 |
| 7,263,373 | B2 | 8/2007 | Mattisson | |
| 7,266,189 | B1 | 9/2007 | Day | |
| 7,378,963 | B1 | 5/2008 | Begault et al. | |
| 7,536,029 | B2 | 5/2009 | Choi et al. | |
| 8,644,519 | B2 | 2/2014 | Pance et al. | |
| 2001/0017924 | A1 | 8/2001 | Azima et al. | |
| 2001/0026625 | A1 | 10/2001 | Azima et al. | |
| 2002/0012442 | A1 | 1/2002 | Azima et al. | |
| 2002/0037089 | A1 | 3/2002 | Usuki et al. | |
| 2002/0044668 | A1 | 4/2002 | Azima | |
| 2002/0150219 | A1 | 10/2002 | Jorgenson et al. | |
| 2003/0048911 | A1 | 3/2003 | Furst et al. | |
| 2003/0053643 | A1 | 3/2003 | Bank et al. | |
| 2003/0161493 | A1 | 8/2003 | Hosler | |
| 2004/0156527 | A1 | 8/2004 | Stiles et al. | |
| 2004/0203520 | A1 | 10/2004 | Schritzinger et al. | |
| 2004/0234086 | A1 * | 11/2004 | Cross et al. | 381/150 |
| 2005/0129267 | A1 | 6/2005 | Azima et al. | |
| 2005/0147273 | A1 | 7/2005 | Azima et al. | |
| 2005/0271216 | A1 | 12/2005 | Lashkari | |
| 2006/0005156 | A1 | 1/2006 | Korpipaa et al. | |
| 2006/0023898 | A1 | 2/2006 | Katz | |
| 2006/0072248 | A1 | 4/2006 | Watanabe et al. | |
| 2006/0109256 | A1 * | 5/2006 | Grant et al. | 345/173 |
| 2008/0204379 | A1 | 8/2008 | Perez-Noguera | |
| 2008/0292112 | A1 | 11/2008 | Valenzuela et al. | |
| 2009/0247237 | A1 | 10/2009 | Mittleman et al. | |
| 2009/0274315 | A1 | 11/2009 | Carnes et al. | |
| 2009/0316943 | A1 | 12/2009 | Munoz et al. | |
| 2010/0103776 | A1 | 4/2010 | Chan | |
| 2011/0002487 | A1 | 1/2011 | Panther et al. | |
| 2011/0033064 | A1 | 2/2011 | Johnson et al. | |
| 2011/0161074 | A1 | 6/2011 | Pance et al. | |
| 2011/0243369 | A1 | 10/2011 | Wang | |
| 2011/0274303 | A1 | 11/2011 | Filson et al. | |
| 2012/0082317 | A1 | 4/2012 | Pance et al. | |
| 2012/0250928 | A1 | 10/2012 | Pance et al. | |
| 2012/0263019 | A1 | 10/2012 | Armstong-Muntner | |
| 2012/0306823 | A1 | 12/2012 | Pance et al. | |
| 2013/0028443 | A1 | 1/2013 | Pance et al. | |
| 2013/0051601 | A1 | 2/2013 | Hill et al. | |
| 2013/0129122 | A1 | 5/2013 | Johnson et al. | |
| 2013/0142355 | A1 | 6/2013 | Isaac et al. | |
| 2013/0142356 | A1 | 6/2013 | Isaac et al. | |

FOREIGN PATENT DOCUMENTS

| | | |
|---|---|---|
| GB | 2342802 | 4/2000 |
| JP | 2102905 | 4/1990 |
| JP | 7015797 | 1/1995 |
| JP | 2009267779 | 11/2009 |
| TW | 201021587 | 6/2010 |
| WO | WO-03049494 | 6/2003 |
| WO | WO-2004025938 | 3/2004 |
| WO | WO-2007045908 | 4/2007 |
| WO | WO-2007083894 | 7/2007 |
| WO | WO-2008153639 | 12/2008 |
| WO | WO-2009017280 | 2/2009 |
| WO | WO-2011057346 | 5/2011 |

OTHER PUBLICATIONS

Final Office Action (dated Jan. 17, 2013), U.S. Appl. No. 12/895,526, Date Filed—Sep. 30, 2010, First Named Inventor: Aleksandar Pance, 20 pages.

PCT International Preliminary Report on Patentability (dated Apr. 11, 2013), International Application No. PCT/US2011/052589, International Filing Date—Sep. 21, 2011, 9 pages.

Non-Final Office Action (dated Mar. 25, 2013), U.S. Appl. No. 13/076,819, Date Filed—Mar. 31, 2011, First Named Inventor: Aleksandar Pance, 13 pages.

Final Office Action (dated Aug. 2, 2013), U.S. Appl. No. 13/076,819, Date Filed—Mar. 31, 2011, First Named Inventor: Aleksandar Pance, 11 pages.

Non-Final Office Action (dated Dec. 30, 2013), U.S. Appl. No. 13/076,819, Date Filed—Mar. 31, 2011, First Named Inventor: Aleksandar Pance, 12 pages.

Non-Final Office Action (dated Oct. 22, 2012), U.S. Appl. No. 12/895,526, Date Filed—Sep. 30, 2010, First Named Inventor: Aleksandar Pance, 27 pages.

"Snap fit theory", Feb. 23, 2005, DSM, p. 2, 1 page.

Baechtle, et al., "Adjustable Audio Indicator", IBM, (Jul. 1, 1984), 2 pages.

Pingali, et al., "Audio-Visual Tracking for Natural Interactivity", Bell Laboratories, Lucent Technologies, (Oct. 1999), pp. 373-382.

* cited by examiner

MAGNETICALLY BIASED ELECTROMAGNET FOR AUDIO APPLICATIONS

FIELD

An embodiment of the invention is directed to a biased electromagnet for audio electronic devices. Other embodiments are also described and claimed.

BACKGROUND

In modern consumer electronics, audio capability is playing an increasingly larger role as improvements in digital audio signal processing and audio content delivery continue to happen. There is a range of consumer electronics devices that are not dedicated or specialized audio playback devices, yet can benefit from improved audio performance. For instance, portable computing devices such as laptops, notebooks, and tablet computers are ubiquitous, as are portable communications devices such as smart phones. These devices, however, do not have sufficient space to house high fidelity speakers. This is also true to a lesser extent for desktop personal computers and low profile television sets with built-in speakers.

Generally, as a speaker decreases in size it is able to move less volume and thus sound quality (or at least loudness) may decrease. This may be especially noticeable for sounds in the lower end of the audio spectrum, e.g., beneath 1 kHz. Furthermore, the available volume within an electronic device shrinks, which in turn provides less air for a speaker to react against and thus limits the audible response. Similarly, the sound level and frequencies able to be produced by a speaker may also decrease as the size of the speaker decreases. Thus, as electronic devices continue to decrease in size, detrimental effects may be experienced for audio produced by the devices.

SUMMARY

An embodiment of the invention is an electronic device including an enclosure having a top panel and a bottom panel. An electromagnet is mounted within the enclosure, the electromagnet includes a core portion attached to the top panel and a coil connected to the core portion. An attractor plate may be attached to the bottom panel. The attractor plate forms part of a magnetic circuit of the electromagnet such that the application of an electrical audio signal to the electromagnet causes the bottom panel to move and produce a sound. A permanent magnet is also attached to the core portion, the permanent magnet is configured to create a bias in the magnetic circuit so as to modify a distortion in the sound.

Another embodiment is directed to an electronic audio system including an enclosure having a first panel operably connected to a second panel. A transducer is mounted within the enclosure. The transducer includes an electromagnet having a core portion operably connected to the first panel and a coil operably connected to the core portion. The transducer further includes an attractor plate operably connected to the second panel, the attractor plate forms part of a magnetic circuit of the electromagnet such that an electrical audio signal input to the electromagnet creates a dynamic force between the first panel and the second panel so as to generate a sound. The transducer further includes a permanent magnet operably connected to the core portion, the permanent magnet is configured to create a biased force between the attractor plate and the electromagnet so as to modify a distortion in the sound. The electronic audio system further includes a memory to store an operating system program and a processor coupled to the memory to execute the operating system program.

In another embodiment, a method of outputting sound from an electronic device is disclosed. The method includes generating a sound by producing a dynamic force between a first panel and a second panel of an enclosure of an electronic device. Producing the dynamic force may include applying an electrical audio signal to an electromagnet associated with the first panel so as to create a magnetic circuit which attracts the second panel to the first panel. The method further including biasing the magnetic circuit so as to modify a distortion in the sound.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments are illustrated by way of example and not by way of limitation in the figures of the accompanying drawings in which like references indicate similar elements. It should be noted that references to "an" or "one" embodiment in this disclosure are not necessarily to the same embodiment, and they mean at least one.

DETAILED DESCRIPTION

In this section we shall explain several preferred embodiments of this invention with reference to the appended drawings. Whenever the shapes, relative positions and other aspects of the parts described in the embodiments are not clearly defined, the scope of the invention is not limited only to the parts shown, which are meant merely for the purpose of illustration. Also, while numerous details are set forth, it is understood that some embodiments of the invention may be practiced without these details. In other instances, well-known structures and techniques have not been shown in detail so as not to obscure the understanding of this description.

Figure 1A:
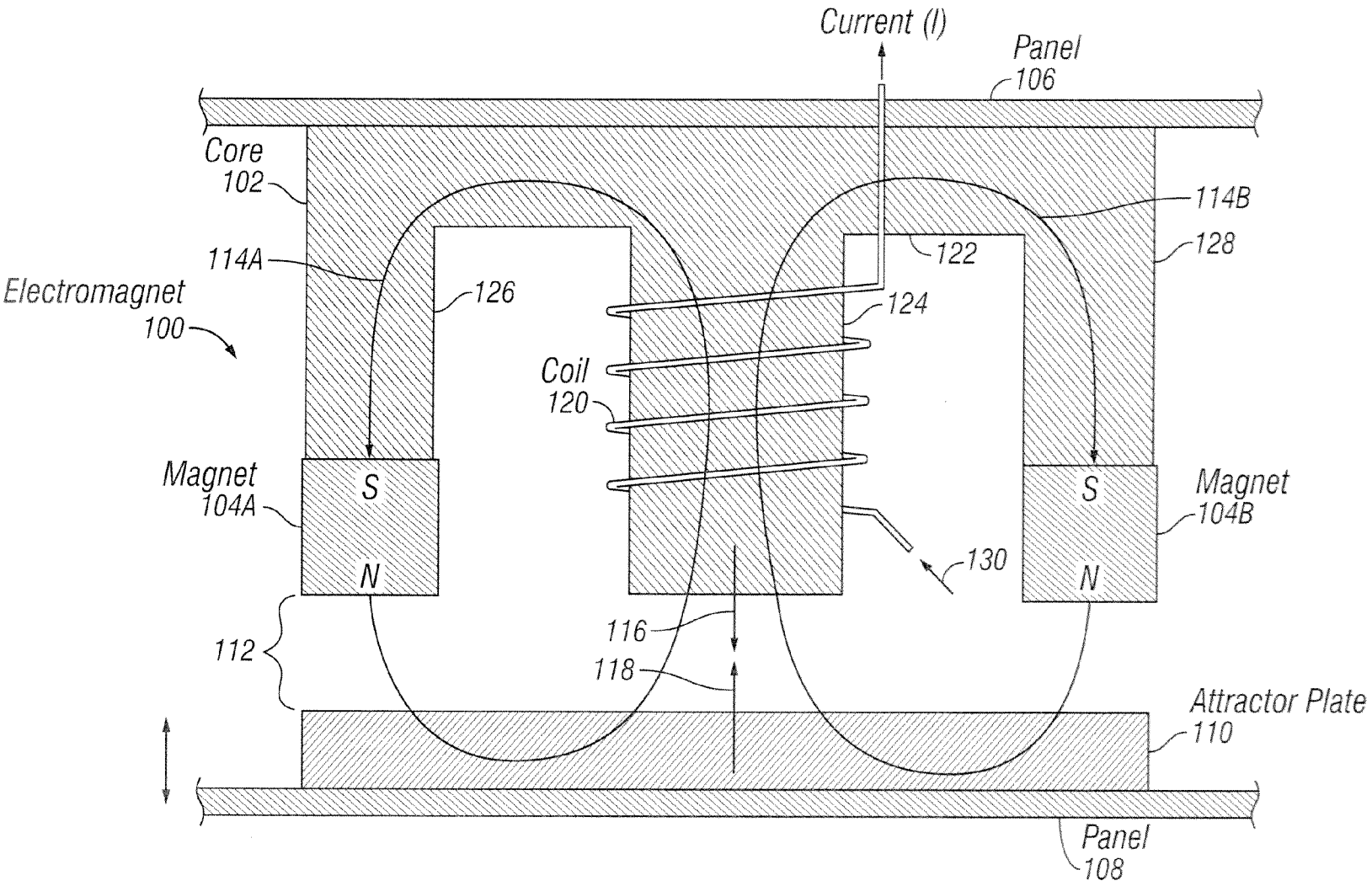
FIG. 1A is a cross-sectional side view of one embodiment of a magnetically biased electromagnet.
Figure 1B:
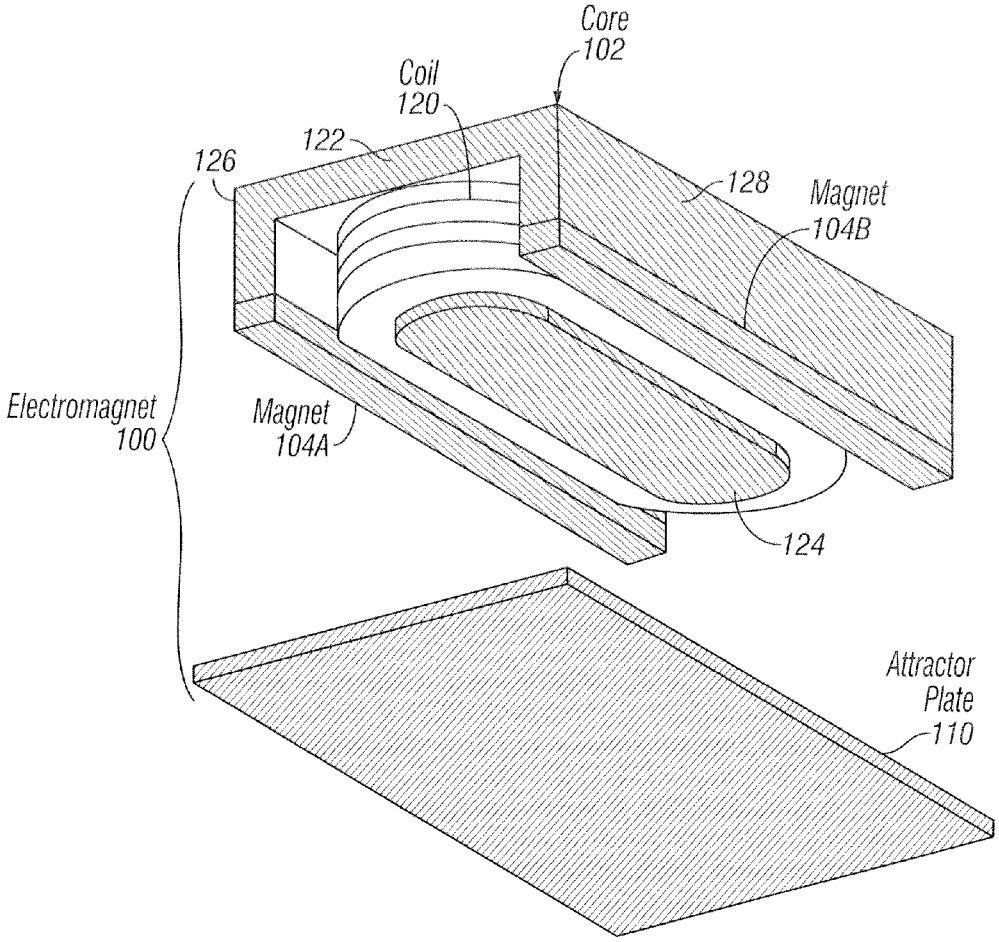
FIG. 1B is a bottom perspective exploded view of the magnetically biased electromagnet of FIG. 1A.

FIG. 1A illustrates a cross-sectional side view of one embodiment of a magnetically biased electromagnet. FIG. 1B illustrates an exploded perspective view of the electromagnet of FIG. 1A. Electromagnet 100 may act as a transducer that can be used to produce a dynamic force between two or more components in order to generate sound using an applied electrical current. In one embodiment, the components may be opposing panels of an enclosure for an electronic audio device, for example, a top panel 106 and a bottom panel 108. Top panel 106 and bottom panel 108 may be connected by sidewalls such that they can contain components of the audio device, for example, a keyboard housing of a laptop computer.

Electromagnet 100 may drive movement of top panel 106 or bottom panel 108 with respect to the other in order to generate a sound. To do so, in one embodiment, electromagnet 100 may be attached to top panel 106 and an attractor plate 110 may be attached to bottom panel 108. In this embodiment, electromagnet 100 and attractor plate 110 are separate and independent structures which are separately attached to their associated panels. Attractor plate 110 may be a substantially planar structure such that it does not substantially affect a Z-height of the overall enclosure (e.g. a thickness or vertical height of the enclosure as viewed in FIG. 1A). In one embodiment, attractor plate 110 may be made of a ferromagnetic material (e.g., iron) and mounted to a surface of bottom panel 108 which faces electromagnet 100. A gap 112 may be formed between electromagnet 100 and attractor plate 110 such that they have space to move vertically with respect to one another. Application of an electrical audio signal to electromagnet 100 creates one or more of magnetic circuits 114A and 114B between electromagnet 100 and attractor plate 110. Magnetic circuits 114A and 114B create an attractive dynamic force between electromagnet 100 and attractor plate 110 as illustrated by arrows 116 and 118. In one embodiment, top panel 106 is a substantially stationary structure and bottom panel 108 is moveable. In this aspect, the attractive force pulls attractor plate 110 toward electromagnet 100 and in turn pulls bottom panel 108 toward top panel 106. In some cases, the entire bottom panel 108 moves, while in others a portion of the bottom panel 108 attached to attractor plate 110 bows out toward electromagnet 100. Electromagnet 100 may be used to move the bottom panel 108 toward and away from electromagnet 100 such that bottom panel 108 serves essentially as a diaphragm which can be used to generate a sound to enhance an acoustic performance of the associated electronic device.

It should be understood, however, that although electromagnet 100 is described as being attached to a stationary top panel 106 while attractor plate 110 is attached to a movable bottom panel 108, other configurations are possible depending upon which of the associated components are to be moved. For example, in some embodiments, top panel 106 may be movable while bottom panel 108 is stationary such that the electromagnet 100 and attractor plate 110 move top panel 106 while bottom panel 108 remains stationary. In another example, electromagnet 100 may be attached to a movable panel (panel 108) while attractor plate 110 is attached to a stationary panel (panel 106) such that the panel attached to electromagnet 100 moves while the panel attached to attractor plate 110 remains stationary. Also, although the terms "top panel" and "bottom panel" are used herein, it does not necessarily mean that one panel is on top of the other, and in some cases the bottom panel may form a top or side of the enclosure or the top panel may form a bottom or side of the enclosure, for example, where the electronic device is flipped over or flipped on its side. In addition, although electromagnet 100 and attractor plate 110 are described as being attached to top panel 106 and bottom panel 108, respectively, they may be attached to any type of component or structure where movement of one with respect to the other is desired.

It should further be understood that an advantage of using electromagnet 100 and attractor plate 110 to produce a dynamic force between top panel 106 and bottom panel 108, as compared to a typical moving coil design, is that the electromagnet 100 sits on one component (top panel 106 in this case) and only a passive attractor plate 110 sits on the other component (bottom panel 108 in this case). This allows the transducer to be tolerant of relative positioning (e.g. horizontal positioning) of one component with respect to the other. This is in contrast to a moving coil configuration in which the magnet and the coil are attached to separate components and therefore have to be accurately aligned in both the horizontal and vertical directions.

Referring in more detail to electromagnet 100, electromagnet 100 includes a core portion 102 and associated coil 120. Coil 120 may be made of an electrically conductive material such that transmission of an electrical current through coil 120 creates a magnetic field which can be concentrated within core portion 102. In one embodiment, the core portion 102 may include a base portion 122 which is a substantially planar member which is mounted within the enclosure, on or near top panel 106. A coil support arm 124 and side arms 126 and 128 extend from base portion 122 in a direction of bottom panel 108. Side arms 126 and 128 are spaced a distance from opposing sides of coil support arm 124 such that coil 120 can be positioned around coil support arm 124. Although three arms are shown extending from base portion 122, it is contemplated that core portion 102 may include any number of arms sufficient to support the associated coil and allow for attachment of a component such as top panel 106. In some embodiments, core portion 102 and the associated coil 120 are attached directly to top panel 106, such as by a bolt, screw or the like through base portion 122, while in other embodiments, a bracket assembly may be used to attach core portion 102 and the associated coil 120 to top panel 106. Core portion 102 may be one integrally formed structure made of any material suitable for forming an electromagnet core (e.g., a ferromagnetic material such as iron).

In some embodiments, permanent magnets 104A and 104B are attached to the ends of side arms 126 and 128, respectively, facing attractor plate 110. In one embodiment, side arms 126 and 128 may have a length which is less than coil support arm 124 so as not to increase an overall height of electromagnet 100 when permanent magnets 104A and 104B are attached thereto. Such a configuration also helps to maintain the spacing of gap 112 between electromagnet 100 and attractor plate 110. Permanent magnets 104A and 104B are used to create a bias force between attractor plate 110 and electromagnet 100. This bias force is important to the acoustic performance of the device because it allows the sound created by movement of the bottom panel 108 to be accurately recreated from the dynamic input electrical audio signal without distortion. In particular, as previously discussed, electromagnet 100 creates an attractive force with attractor plate 110. Since only attractive forces are possible, the input electrical audio signal is rectified and therefore any corresponding dynamic force produced by the audio signal is not proportional to the audio signal (i.e. any audio signal current below zero is output as a positive dynamic force). This, in turn, results in a distorted sound output.

Figure 2A:
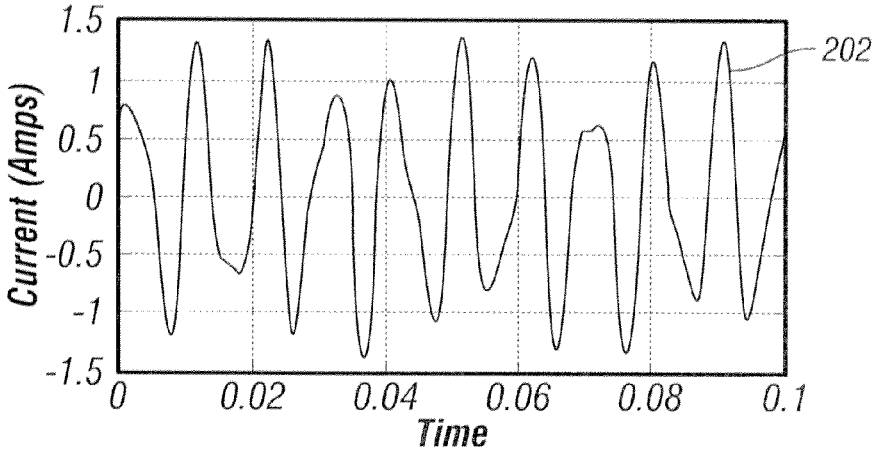
FIG. 2A is one embodiment of an audio signal waveform.
Figure 2B:
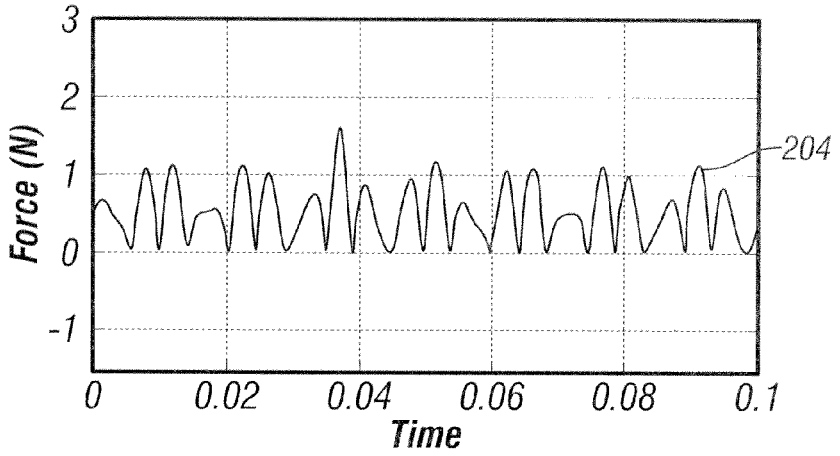
FIG. 2B is one embodiment of a rectified audio signal waveform.
Figure 2C:
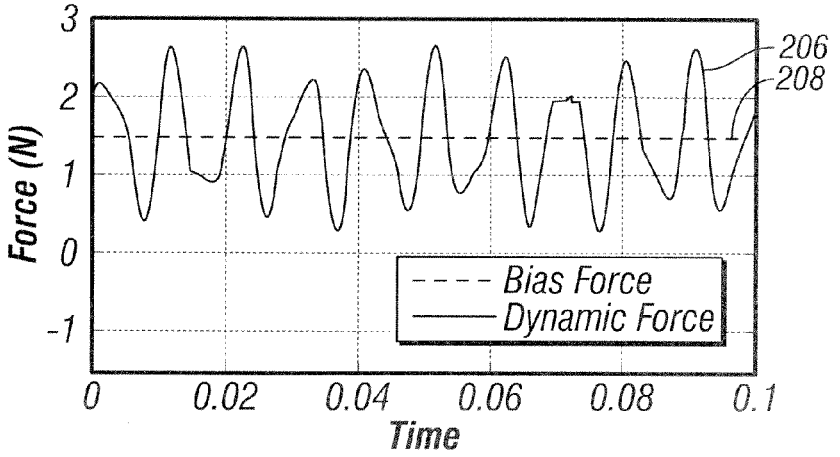
FIG. 2C is one embodiment of a biased audio signal waveform associated with a sound produced by an electronic device within which a magnetically biased electromagnet is implemented.

The concepts of a bias force and rectification of the audio signal may be better understood in reference to FIG. 2A, FIG. 2B and FIG. 2C. In particular, FIG. 2A illustrates an undistorted audio signal waveform 202 in which the Y-axis represents the current (Amps) and the X-axis represents time. It can be seen that the current levels change with time and alternate between positive values and negative values. In the absence of the biased force created by permanent magnets 104A and 104B, these negative values are output as positive forces (i.e., rectified), thus distorting the sound. FIG. 2B illustrates the rectified dynamic force waveform 204, which corresponds to audio signal waveform 202 when the bias force is not present. The Y-axis represents the force (N) and the X-axis represents time. From waveform 204, it can be seen that when force (N) is greater than 0, as is the case when only attractive forces are possible, the negative portions of audio signal waveform 202 illustrated in FIG. 2A are rectified as shown in FIG. 2B and thus the audio signal 202 is distorted. FIG. 2C illustrates the audio signal of FIG. 2A when the biased force is created between attractor plate 110 and electromagnet 100 by permanent magnets 104A and 104B. The biased force 208, in this case approximately 1.5N, biases the signal waveform 206 in a positive direction so that the entire audio signal waveform 202 of FIG. 2A is above zero and can therefore be recreated as a dynamic force without the distortion. In other words, as a result of the biased force 208, the dynamic force produced by the electromagnet is proportional to the dynamic input audio signal. Although a bias force of approximately 1.5N is illustrated, it is to be understood that any bias force necessary to reduce the distortions may be used. For example, the bias force may be from about 0.5N to about 2.5N, for example, from about 1N to about 1.5N.

With the foregoing in mind, the manner in which permanent magnets 104A and 104B create the biased force and allow for the sound created by bottom panel 108 to be recreated from the dynamic audio signal without distortion will now be described in more detail. Representatively, referring back to FIG. 1A, when an electrical audio signal is applied to coil 120 of electromagnet 100 in a direction of arrow 130, magnetic circuits 114A and 114B are created. Magnetic circuits 114A and 114B create an attractive force between electromagnet 100 and attractor plate 110. This attractive force pulls attractor plate 110, and the associated bottom panel 108, toward electromagnet 100. Permanent magnets 104A and 104B are positioned within magnetic circuits 114A and 114B, respectively, such that sometimes the magnetic circuits created by coil 120 are with (i.e., add to) the magnetic force created by permanent magnets 104A and 104B and sometimes they are against (i.e., subtract from) the magnetic force of permanent magnets 104A and 104B. When magnetic circuits 114A and 114B are with the magnetic force, the bottom panel 108 is pulled closer to the electromagnet 100, i.e., panel 108 moves or bows in a direction of electromagnet 100. When the circuits 114A and 114B are against the magnetic force, the bottom panel 108 is pulled less close to the electromagnet 100, i.e., panel 108 returns to the resting, non-bowed or less bowed configuration. In either case, there is always a biased force between attractor plate 110 and electromagnet 100 due to permanent magnets 104A and 104B such that the dynamic force, which drives movement of panel 108, is proportional to the input electrical audio signal (as illustrated by FIG. 2C) and therefore the resulting sound can be recreated without distortion.

It is noted that the distance the attractor plate 110, and in turn bottom panel 108, travel to or from electromagnet 100 may be varied by varying the electrical charge to which coil 120 is subjected. In this manner, attractor plate 110 may be driven by electromagnet 100 in precise motions depending upon the strength and duration of the electrical current applied to the coil. The motion of the corresponding panel, in this case bottom panel 108, produces audible sound waves which can enhance an acoustic response of the overall audio device. Thus the attractor plate 110 in combination with electromagnet 100 essentially serves as a transducer in which bottom panel 108 operates similar to the diaphragm found in the conventional audio transducer.

In some embodiments, bottom panel 108 may produce audible low frequency sound waves (e.g., sound waves of below 1 kilohertz frequency) as well as other audio frequency sounds. Bottom panel 108 may have a greater surface area than a diaphragm of a typical speaker that may be contained within the electronic device, as such, it may move more air and thus produce more (and possibly clearer) audio. That is, because the bottom panel 108 may have a larger surface area than other speakers installed within the electronic device, the sound produced by causing the bottom panel 108 to move may be louder than traditional speakers. Also, because the electromagnet 100 utilizes the whole enclosure to move most of the air, the actual size of the transducer assembly (i.e., electromagnet 100 and attractor plate 110) may be quite small in comparison to a traditional speaker capable of outputting the same volume of audio. This is beneficial due to the limited space within typical electronic device enclosures. Thus, the transducer assembly may save space, while producing a loud sound often not achievable by ordinary speakers within the space constrains of the enclosure(s).

Returning now to the configuration of permanent magnets, in one embodiment, permanent magnets 104A and 104B may be attached (e.g., chemically attached, welded, screwed, or the like) to an end of side arms 126 and 128, respectively, such that they face attractor plate 110 and are within the magnetic circuit created by electromagnet 100. Permanent magnets 104A and 104B may be positioned such that their poles face the same direction. In other words, both permanent magnets 104A and 104B are oriented so that their South poles face attractor plate 110 or so that their North poles face attractor plate 110. Permanent magnets 104A and 104B may extend along the entire length of side arms 126 and 128 as illustrated by the exploded view of FIG. 1B. In other embodiments, one or more of permanent magnets 104A and 104B may extend along only a portion of the length of side arms 126 and 128. Permanent magnets 104A and 104B may be made of any material suitable for forming permanent magnets having the desired biasing force, for example, a hard ferromagnetic material such as alnico or ferrite.

Figure 3:
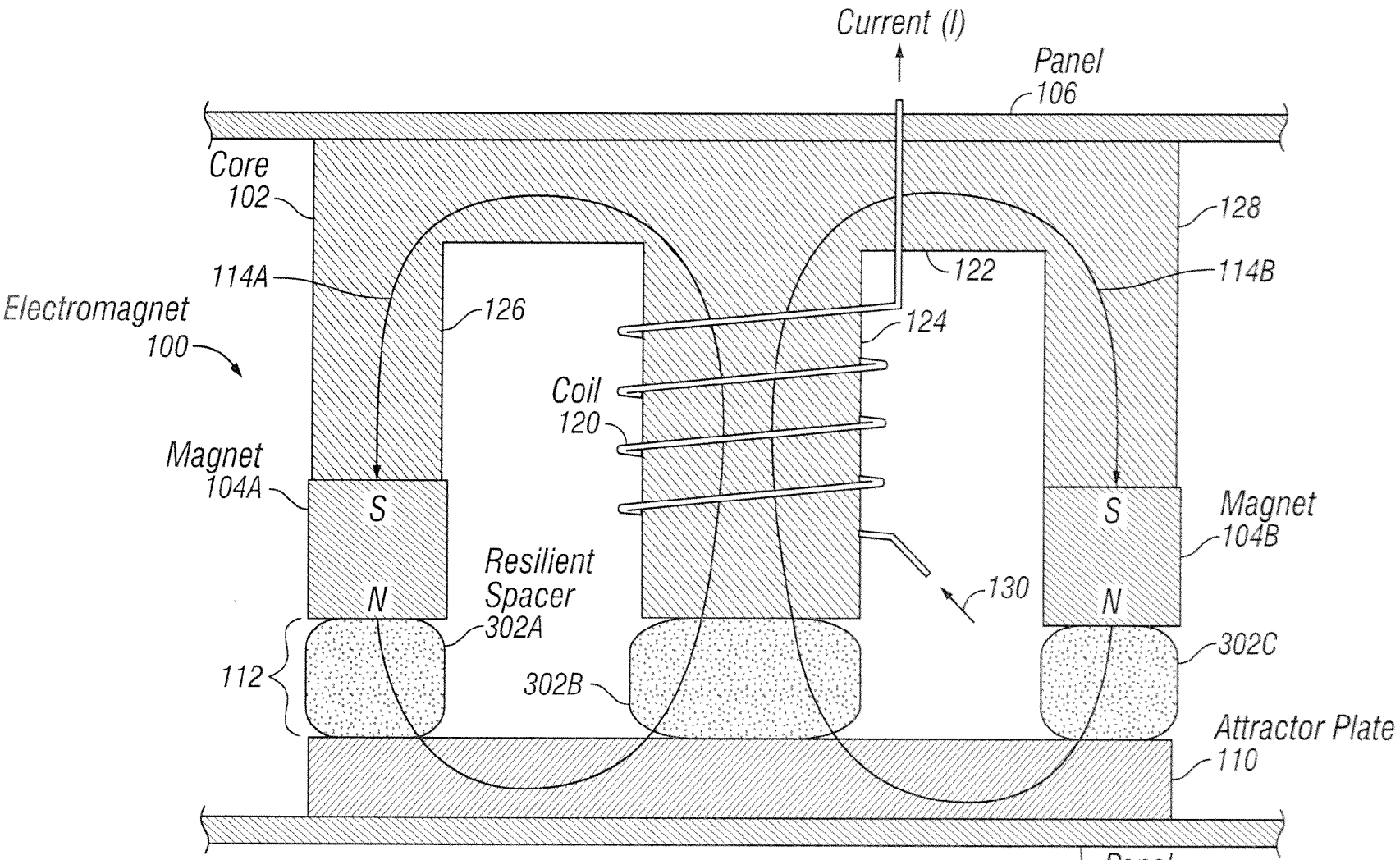
FIG. 3 is a cross-sectional side view of another embodiment of a magnetically biased electromagnet.

FIG. 3 illustrates a cross-sectional side view of another embodiment of a magnetically biased electromagnet. Each of the aspects of electromagnet 100, attractor plate 110 and permanent magnets 104A, 104B illustrated in this view are substantially the same as those discussed in reference to FIG. 1A. In addition the previously discussed aspects, resilient spacers 302A, 302B and 302C are provided within gap 112 between electromagnet 100 and attractor plate 110. Resilient spacers 302A-302C may allow for more accurate vertical alignment of electromagnet 100 with respect to attractor plate 110 as well as allow some relative misalignment in the horizontal direction. In addition, resilient spacers 302A-302C may create a push force between electromagnet 100 and attractor plate 110. As previously discussed, the force created between electromagnet 100 and attractor plate 110 is only an attractive or pull force. Resilient spacers 302A-302C may therefore add a push force which helps with movement of attractor plate 110 and the associated panel 108 with respect to electromagnet 100. In this aspect, resilient spacers 302A-302C may be dimensioned to fit within the gap 112 provided between electromagnet 100 and attractor plate 110 so that a relatively consistent vertical spacing range may be maintained between electromagnet 100 and attractor plate 110. In one embodiment, resilient spacers 302A-302C may be dimensioned so that they are always slightly compressed between electromagnet 100 and attractor plate 110 and more compressed when an electrical current 130 is applied to electromagnet 100. In other words, when the electromagnet 100 and attractor plate 110 are in a rest position (e.g., applied electrical current is zero), resilient spacers 302A-302C are slightly compressed such that they apply a push force which wants to push attractor plate 110 away from electromagnet 100. In an actuated position (e.g., electrical current is greater than zero), resilient spacers 302A-302C are compressed even further as attractor plate 110 is pulled toward electromagnet 100 by the magnetic circuits 114A, 114B.

Resilient spacers 302A-302C may be attached to the ends of, and run along an entire length of, each of side arms 126, 128 and coil support arm 124. Alternatively, resilient spacers 302A-302C may run along only a portion of the arms, or be attached to less than each of side arms 126, 128 and coil support arm 124 as illustrated. Still further, it is contemplated that one or more of resilient spacers 302A-302C may be omitted such that they are attached to less than each of each of side arms 126, 128 and coil support arm 124.

Resilient spacers 302A-302C may be made of any resilient structure or material suitable for maintaining a vertical alignment and/or enhancing movement between electromagnet 100 and attractor plate 110. For example, one or more of resilient spacers 302A-302C could be made of a block of resilient or elastic material such as a rubber or foam material. Alternatively, resilient spacers 302A-302C could be made of a spring or other resilient structure. In some embodiments, resilient spacers 302A-302C may contain a ferromagnetic material such that they help to improve an efficiency of the magnetic circuit. Representatively, resilient spacers 302A-302C may be made entirely of a ferromagnetic material (e.g., an iron spring) or they may be made of a composite of a resilient material such as a rubber or elastic material which is embedded with or otherwise contains a ferromagnetic material (e.g., filings) in an amount sufficient to improve the efficiency of the magnetic circuit.

Figure 4:
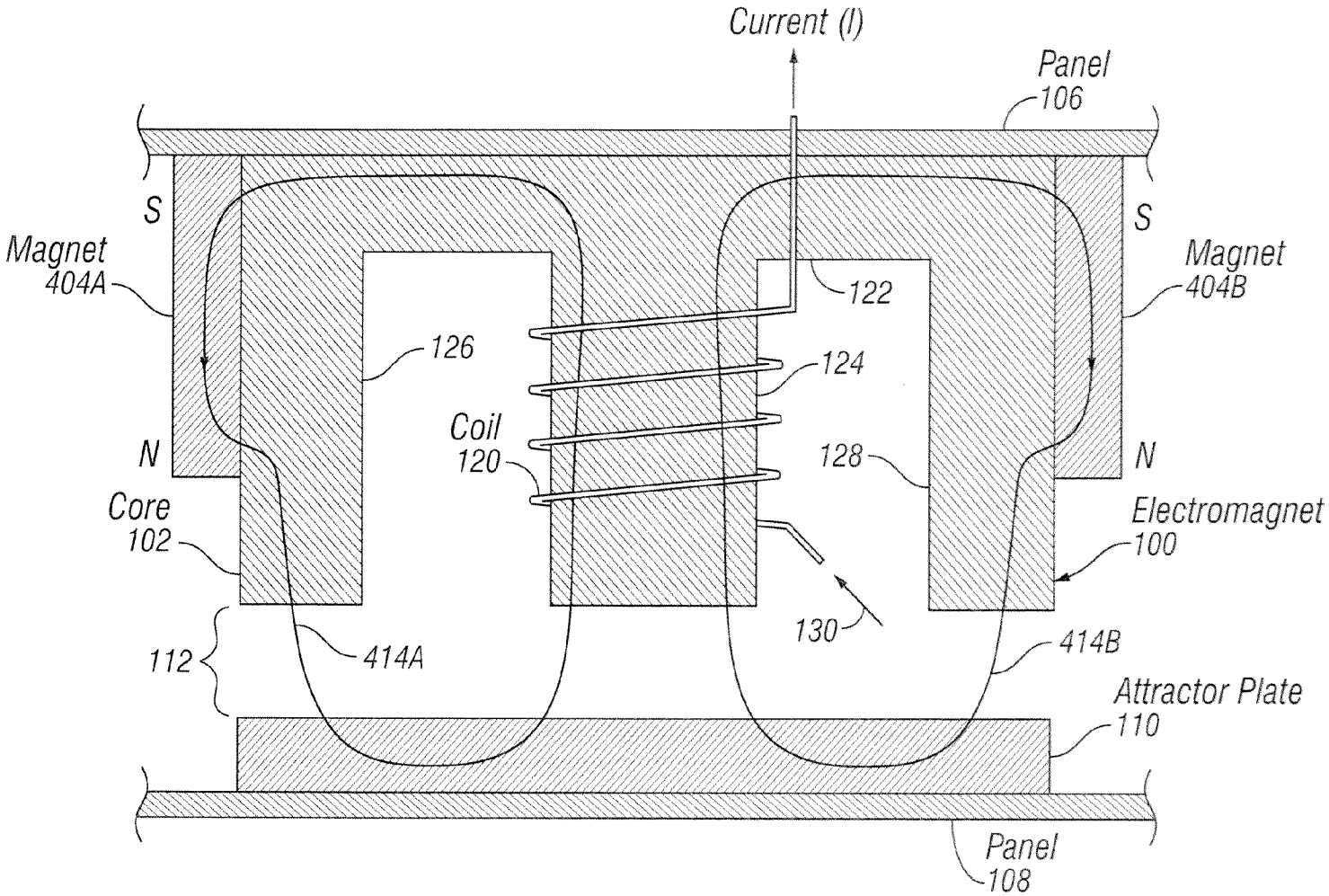
FIG. 4 is a cross-sectional side view of another embodiment of a magnetically biased electromagnet.

FIG. 4 illustrates a cross-sectional side view of another embodiment of a magnetically biased electromagnet. Each of the aspects of electromagnet 100 and attractor plate 110 are substantially the same as those discussed in reference to FIG. 1A except that in this embodiment, permanent magnets 404A and 404B are attached (e.g., welded, bolted or the like) along the side walls of side arms 126 and 128, respectively, of core portion 102. In this aspect, magnetic circuits 414A and 414B are created which extend outside of side arms 126 and 128 and through permanent magnets 404A and 404B. Permanent magnets 404A and 404B may extend along the entire length of side arms 126 and 128 or only a portion of the side arms. In any case, permanent magnets 404A and 404B may have any shape or dimensions sufficient to bias magnetic circuits 414A and 414B and modify a distortion in the audio signal as in the manner previously discussed.

Figure 5:
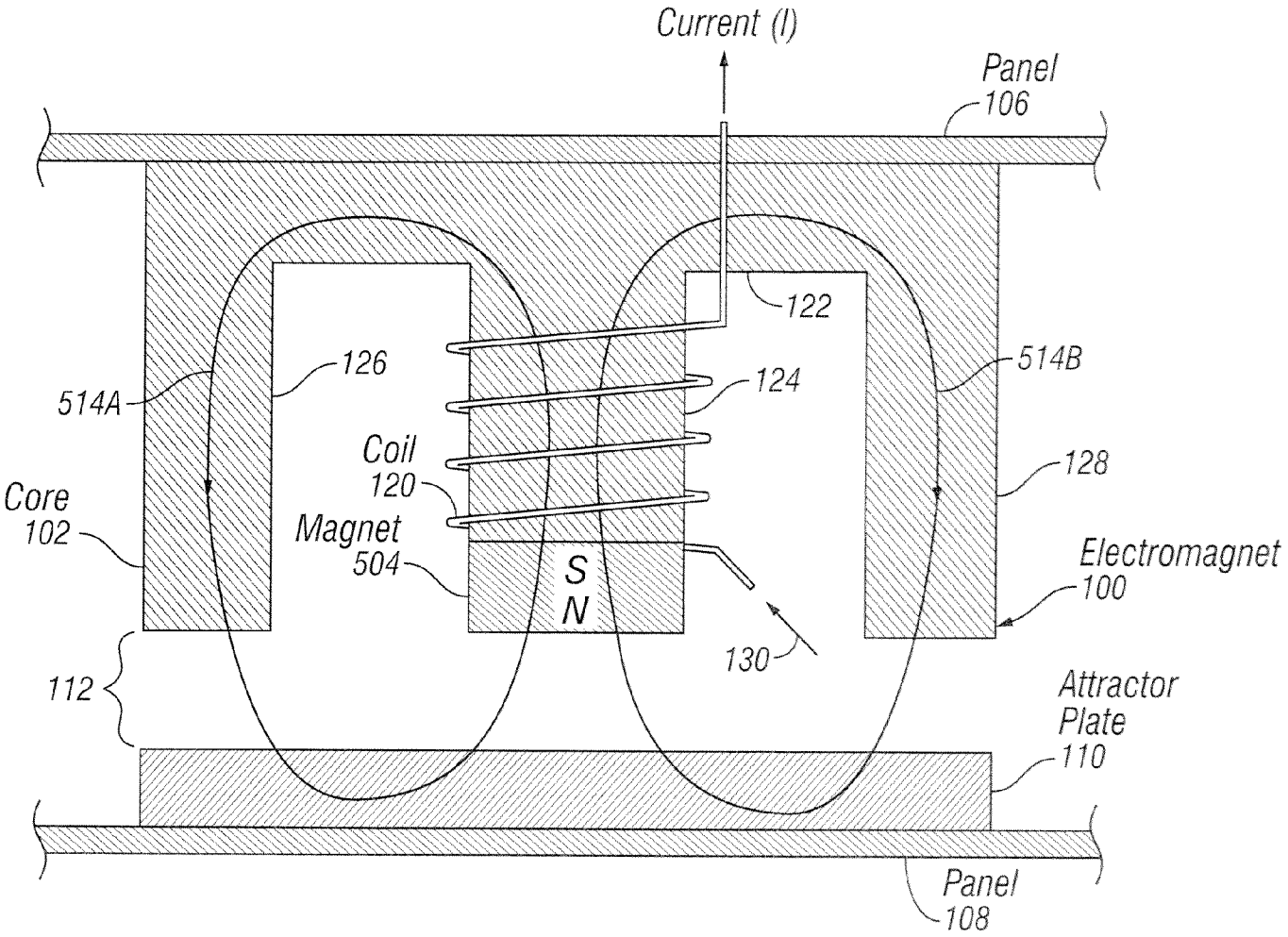
FIG. 5 is a cross-sectional side view of another embodiment of a magnetically biased electromagnet.

FIG. 5 illustrates a cross-sectional side view of another embodiment of a magnetically biased electromagnet. Each of the aspects of electromagnet 100 and attractor plate 110 are substantially the same as those discussed in reference to FIG. 1A except that in this embodiment, permanent magnet 504 is attached (e.g., welded, bolted or the like) to an end of coil support arm 124 facing attractor plate 110. Permanent magnet 504 may extend along an entire length of coil support arm 124 or only a portion of coil support arm 124. In this aspect, magnetic circuits 514A and 514B are created which extend along side arms 126 and 128 and through permanent magnet 504 as shown. Permanent magnet 504 may have any shape or dimensions sufficient to bias magnetic circuits 514A and 514B and modify an acoustic distortion in the manner previously discussed.

It is to be understood that although the previously discussed permanent magnets are shown at specific locations along electromagnet 100, it is contemplated that the permanent magnets may be positioned at any location within the magnetic circuit created by electromagnet 100. Moreover, a single permanent magnet may be positioned within the magnetic circuit or more than one permanent magnet may be positioned within the magnetic circuit, for example, three permanent magnets may be positioned within the magnetic circuit, e.g., one at each end of arms 124, 126 and 128. Moreover, although core portion 102 of electromagnet 100 is shown having three arms 124, 126 and 128, any number of arms sufficient to create a magnetic circuit between electromagnet 100 and attractor plate 120 may be provided. For example, more or fewer than three arms may extend from base portion 122. Representatively, in one embodiment, two arms may extend from base portion 122 and coil 120 positioned around one of the arms or the base portion between the arms. In another embodiment, the arms may be omitted and coil 120 may be positioned around the base portion 122.

In addition, it is contemplated that in some embodiments attractor plate 110 may be omitted and instead, the enclosure opposite the electromagnet 100 and coil 120, which is used to generate the sound (e.g., bottom panel 108), may be made of a material similar to attractor plate 110 (e.g., a ferromagnetic material). In this aspect, the attractive force created by electromagnet 100 pulls the enclosure panel toward electromagnet 100 in the absence of attractor plate 110.

In another embodiment, the bias force between electromagnet 100 and attractor plate 110 may be created by using a direct current (DC) (i.e., bias current) to create the bias instead of permanent magnets and the permanent magnets may be omitted. Representatively, the audio signal may be tracked and the bias signal varied slowly over time such that only a sufficient bias is used in a given section of the audio signal (e.g., a desired section of a song) to stop the force from dropping to zero resulting in signal rectification.

Figure 6A:
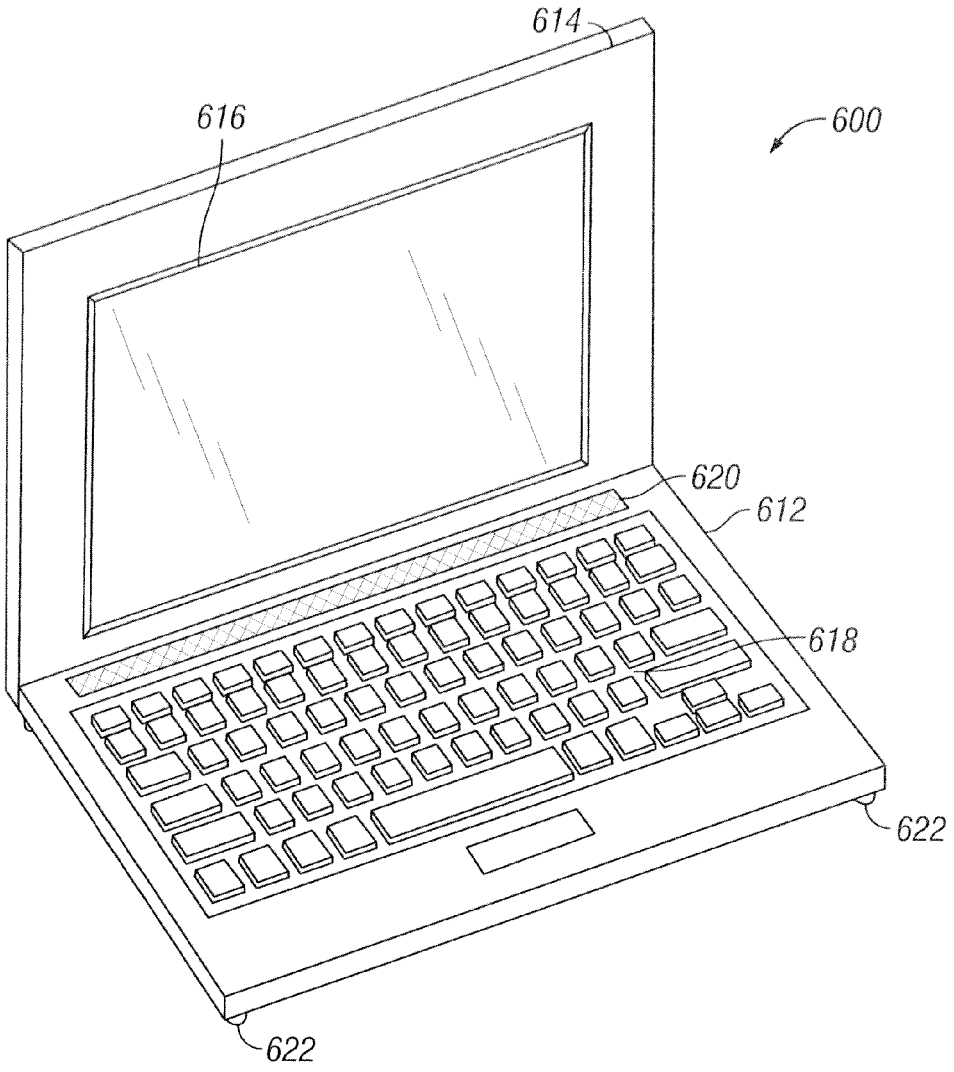
FIG. 6A is a perspective view of one embodiment of an electronic device within which the magnetically biased electromagnet may be implemented.
Figure 6B:
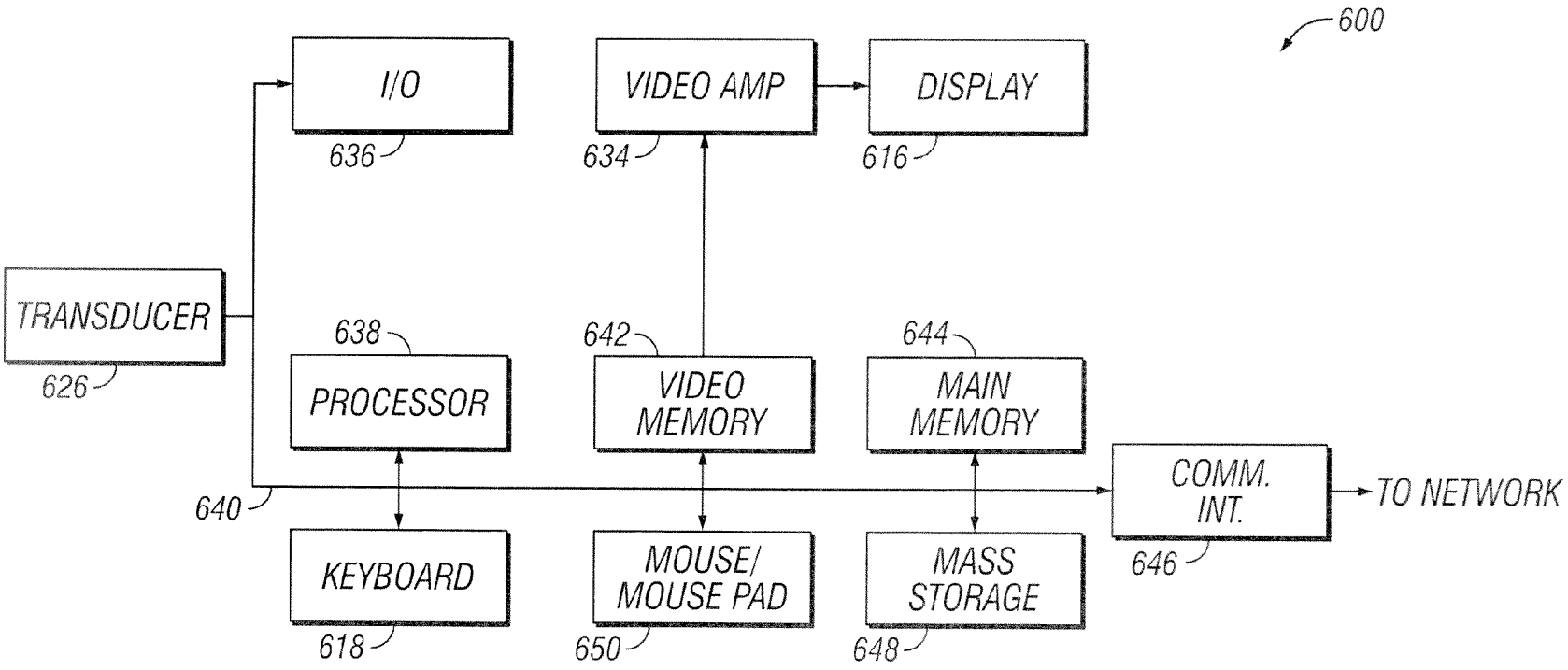
FIG. 6B is a block diagram of certain embodiments of the electronic device illustrated in FIG. 6A.
Figure 7:
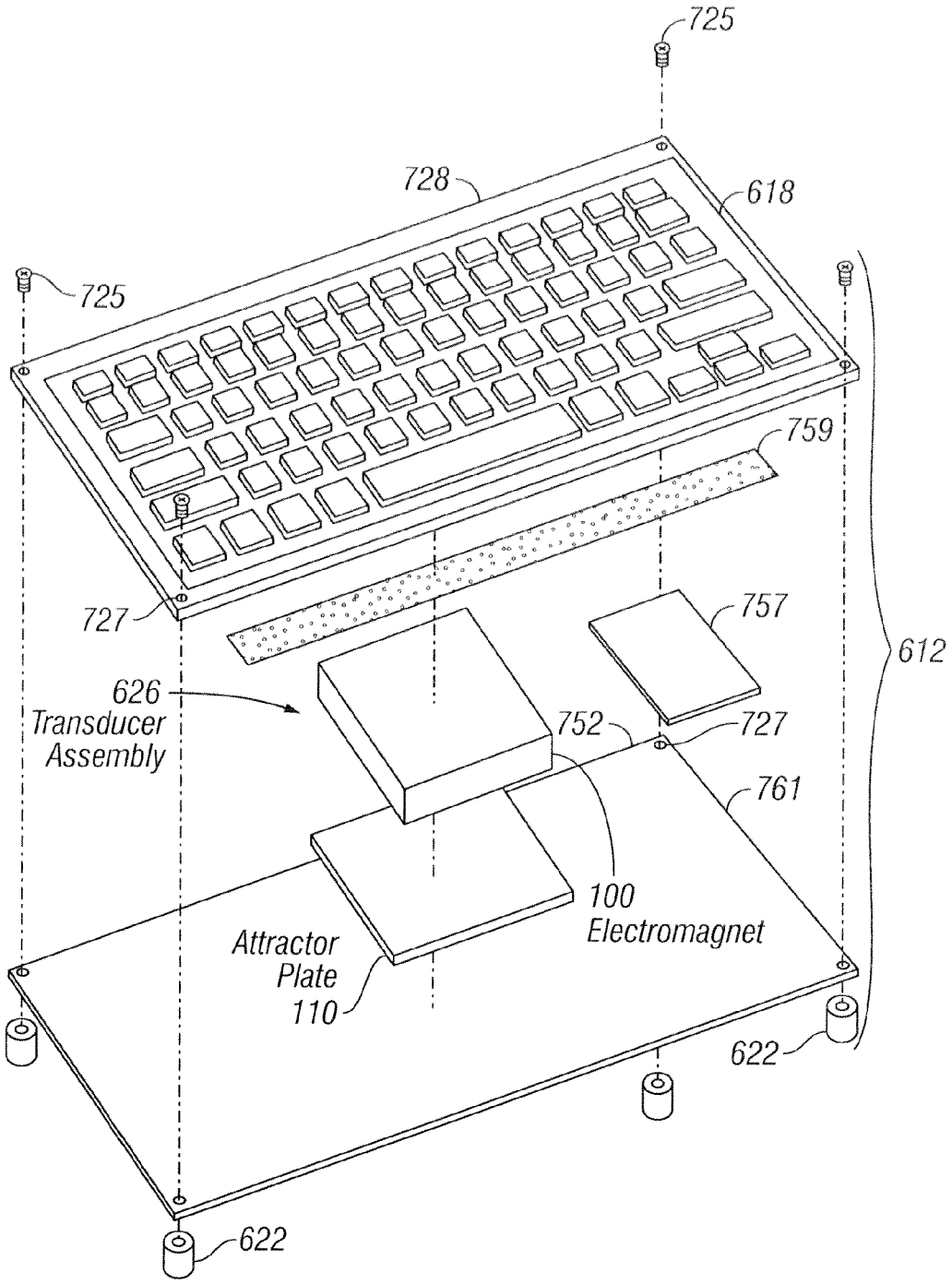
FIG. 7 is an exploded view of a bottom enclosure of the electronic device.

FIG. 6A illustrates a perspective view of one embodiment of an electronic device in which the biased electromagnet described herein may be implemented. FIG. 6B illustrates a block diagram of one embodiment of the electronic device of FIG. 6A. Electronic device 600 may include a top enclosure 614 and a bottom enclosure 612. The enclosures 612, 614 generally surround or enclose the internal components of the electronic device 600, although apertures and the like may be formed into one or both of the enclosures. The electronic device 600 may include a keyboard 618, a display screen 616, a speaker 620, and optional feet 622. Also, the electronic device 600 generally includes an audio transducer assembly 626 (i.e., magnetically biased electromagnet and attractor plate), as shown in FIG. 7, encased within or affixed to one or both of the enclosures 612, 614.

Electronic device 600 may be capable of storing and/or processing signals such as those used to produce images and/or sound. In some embodiments, electronic device 600 may be a laptop computer, a handheld electronic device, a mobile telephone, a tablet electronic device, an audio playback device, such as an MP3 player, and the like. A keyboard 618 and mouse (or touch pad) 650 may be coupled to the electronic device 600 via a system bus 640 (see FIG. 6B). Additionally, in some embodiments, the keyboard 618 and the mouse 650 may be integrated into one of the enclosures 612, 614 as shown in FIG. 6A. In other embodiments the keyboard 618 and mouse 650 may be external to the electronic device 600.

The keyboard 618 and the mouse 650, in one example, may provide user input to the electronic device 600; this user input may be communicated to a processor 638 through suitable communications interfaces, buses and the like. Other suitable input devices may be used in addition to, or in place of, the mouse 650 and the keyboard 618. For example, in some embodiments the electronic device 600 may be a smart phone, tablet computer or the like and include a touch screen (e.g., a capacitive screen) in addition to or in replace of either the keyboard 618, the mouse 650 or both. An input/output unit 636 (I/O) coupled to the system bus 640 represents such I/O elements as a printer, stylus, audio/video I/O, and so on. For example, external speakers may be electrically coupled to the electronic device 600 via an input/outlet connection (not shown).

The electronic device 600 may also include a video memory 642, a main memory 644 and a mass storage 648, all coupled to the system bus 640 along with the keyboard 618, the mouse 650 and the processor 638. In some embodiments, main memory 644 may store an operating system program, which may include instructions for operating electronic device 600. Processor 638 may be configured to execute the operating system program. Processor 638 may be any suitable microprocessor or microcomputer. The mass storage 648 may include both fixed and removable media, such as magnetic, optical or magnetic optical storage systems and any other available mass storage technology. The system bus 640 may contain, for example, address lines for addressing the video memory 642 or the main memory 644.

The system bus 640 also may include a data bus for transferring data between and among the components, such as the processor 638, the main memory 644, the video memory 642 and the mass storage 648. The video memory 642 may be, for example, a dual-ported video random access memory or any other suitable memory. One port of the video memory 642, in one example, is coupled to a video amplifier 634 which is used to drive a display screen 616. The display screen 616 may be any type of screen suitable for displaying graphic images, such as a liquid crystal display, cathode ray tube monitor, flat panel, plasma, or any other suitable data presentation device. Furthermore, in some embodiments the display screen 616 may include touch screen features, for example, the display screen 616 may be capacitive. These embodiments allow a user to enter input into the display screen 16 directly.

The electronic device 600 also may include a communication interface 646 coupled to the system bus 640. The communication interface 646 provides a two-way data communication coupling via a network link. For example, the communication interface 646 may be a satellite link, a local area network (LAN) card, a cable modem, and/or wireless interface. In any such implementation, the communication interface 646 sends and receives electrical, electromagnetic or optical signals that carry digital data streams representing various types of information.

Code and/or other information (e.g. an operating system program) received by the electronic device 600 may be executed by the processor 638 as the code is received. Code may likewise be stored in the mass storage 648, or other non-volatile storage for later execution. In this manner, the electronic device 600 may obtain program code in a variety of forms and from a variety of sources. Program code may be embodied in any form of computer program product such as a medium configured to store or transport computer readable code or data, or in which computer readable code or data may be embedded. Examples of computer program products include CD-ROM discs, ROM cards, floppy disks, magnetic tapes, computer hard drives, servers on a network, and solid state memory devices.

The electronic device 600 may also include an audio transducer 626. The audio transducer 626 may be coupled to the system bus 640, which may in turn electrically connect the audio transducer 626 to any of the processor 638, main memory 644, mass storage 648 and the like. The audio transducer 626 is an output device that produces sound waves in response to electrical signals. The audio transducer 626 may be encased within or otherwise affixed to one of the enclosures 612, 614 and may be used alone or in combination with other output devices (such as an external speaker) to produce sound. Additionally, the audio transducer assembly 626 may mechanically vibrate other surfaces, such as the enclosures 612, 614 and/or a supporting surface on which the device rests, to produce a louder sound. Thus, as the audio transducer 626 responds to the electrical signal it vibrates the enclosure 612, 614, which in turn disturbs air particles and produces sound waves.

FIG. 7 will now be described and embodiments discussed with respect thereto. FIG. 7 illustrates an exploded view of the bottom enclosure 612, showing certain elements of the aforementioned computer device (although some are omitted for clarity). Although audio transducer 626 is shown installed in bottom enclosure 612, it may also be installed in the upper enclosure 614. In certain embodiments, the lower enclosure 612 may include a top panel 728 and a bottom panel 752. The top panel 728 may form the top surface of the bottom enclosure 612 and, in some embodiments, surround the keyboard 618, mouse 650, touch screen (not shown) or other input device, and the like. The bottom panel 752 may form the bottom surface of the bottom enclosure 612 and electronic device 600. Typically, the top panel 728 forms the top surface of the enclosure and may provide access to the keyboard 618 and/or mouse 650. In tablet-style devices, there may be a single enclosure defined by the top and bottom panels.

The enclosures 612, 614 may be constructed out of a variety of materials and, depending on the type electronic device 600, may be constructed in a variety of different shapes. In some embodiments, the enclosures 612, 614 may be constructed out of carbon fiber, aluminum, glass and other similar, relatively stiff materials. The material for the enclosures 612, 614 in some embodiments may improve the sound volume and/or quality produced by the audio transducer 626. This is because in some embodiments the enclosure 612, 614 mechanically vibrates due to vibrations produced by the audio transducer 626, producing sound waves. Thus, the material may be altered to be more responsive to the vibrations and/or more easily move, increasing the sound quality/volume. Additionally, it should be noted that the bottom enclosure 612 and the top enclosure 614 may be constructed out of different materials from each other. Furthermore, in some embodiments the electronic device 600 may only include one of the enclosures 612, 614. For instance, if the electronic device display 616 includes a touch screen or other display device that also accepts input, then the bottom enclosure 612 may be omitted as the keyboard 618 and mouse 650 may be integrated into the top enclosure 614.

The enclosures 612, 614 in some embodiments may be water and/or air-tight. This is because the audio transducer 626, as discussed in more detail below, may not require an air-opening (e.g., a grille or screen) in order for a user to hear sound waves produced by the audio transducer 626. The audio transducer 626 uses the enclosures 612, 614 and/or supporting surface to produce sound waves, as opposed to a diaphragm within a traditional speaker that must be open to the air in order for the sound waves to be heard. Therefore, the enclosures 612, 614 and thus the electronic device 600 may be completely sealed from water and/or air. This may permit the electronic device 600 to be waterproof, more versatile, and allows the electronic device 600 to have a refined, smooth outer appearance. However, as the electronic device 600, may include a combination of an audio transducer 626 and a speaker 620, in other embodiments the enclosures 612, 614 may include a grill/screen.

The bottom panel 752 and the top panel 728 may be connected together in a variety of ways. In the embodiment illustrated in FIG. 7, the top panel 728 and the bottom panel 752 are attached via fasteners 725. The fasteners 725 may be inserted in apertures 727 on both panels 728, 752. Additionally, in some embodiments the fasteners 725 may be used to attach the feet 622 to the bottom panel 752. The top enclosure 614 may be similarly secured to together, including an upper and bottom panel (not shown). In other embodiments, the enclosures 612, 614 may be glued together or otherwise secured. In still other embodiments, the top panel 728 and the bottom panel 758 may include a seal disposed between to create a waterproof, air tight connection. The seal helps prevent elements from entering into the inner cavity of the enclosures 612, 614 when the panels 728, 752 are secured together.

The internal elements described above with regard to FIG. 6B are represented by the circuit boards 757, 759, which are shown in a representative fashion only. More or fewer circuit boards or other circuitry may be present and the shape of the boards/circuitry may vary from what is shown. The circuit boards 757, 759 may include a combination of the elements described above with respect to FIG. 6B, such as main memory 644, video memory 642, mass storage 648, the processor 638 and the like. The circuit boards 757, 759 may be electrically connected to the audio transducer 626 via the system bus 640 or another electrical connection. Furthermore, the circuit boards 757, 759 may be secured to the enclosures 612, 614 and enclosed inside.

The audio transducer 626 may be installed in such a manner that one of the electromagnet 100 and the attractor plate 110 is attached to the top panel 728 while the other is attached to the bottom panel 752. In some instances, the electromagnet 100 may be operably connected to the top panel 728 while the attractor plate 110 is operably connected to the bottom panel 752, but in other embodiments the electromagnet 100 may be operably connected to the bottom panel 752 while the attractor plate 110 is operably connected to the top panel 728. In still other embodiments, the electromagnet 100 may be connected to a circuit boards 757, 759, for instance a motherboard, logic board or the like. Thus, in different embodiments the electromagnet 100 may be connected to either of the panels 728, 752 or either of the circuit boards 757, 759.

Figure 8:
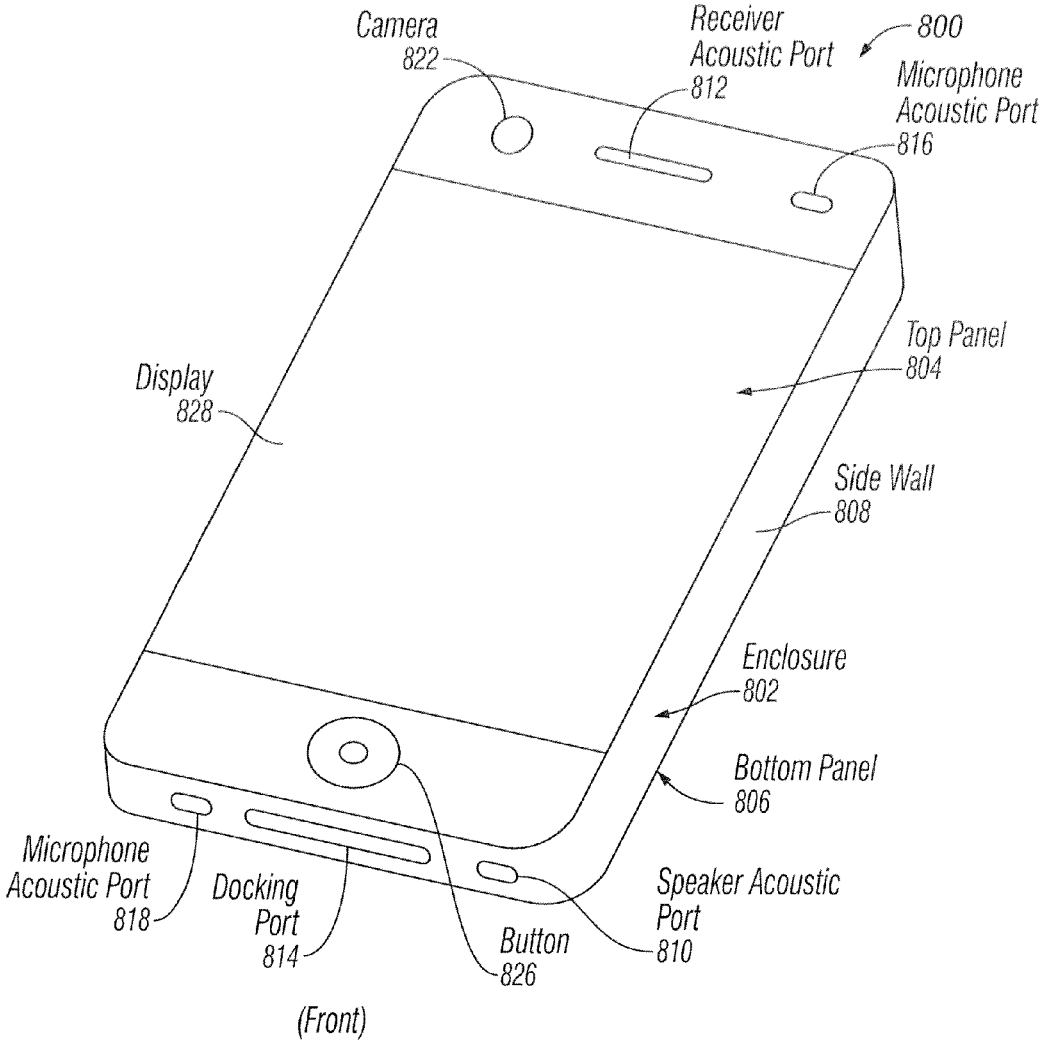
FIG. 8 is a perspective view of another embodiment of an electronic device within which the magnetically biased electromagnet may be implemented.

The concepts described here, however, need not be limited to portable audio devices such as laptop computers. For example, as seen in FIG. 8, the biased electromagnetic transducer may be implemented within a mobile communications device 800 such as a smart phone. Mobile communications device 800 may include an enclosure 802 defining or closing off a chamber in which the constituent electronic components of the communications device 800 are housed. Enclosure 802 may include a front or top panel 804 and a rear or bottom panel 806, which are connected by a sidewall portion 808. The top panel 804 may be considered a display side of the device in that it may include a touch screen display 828 that serves as an input and a display output for the device. The touch screen display 828 may be a touch sensor (e.g., those used in a typical touch screen display such as found in an iPhone® device by Apple Inc.). Although the touch screen is illustrated on top panel 804, if desired, it may be mounted on the bottom panel 806 of device 800, on a side wall portion 808 of device 800, on a flip-up portion of device 800 that is attached to a main body portion of device 800 by a hinge (for example), or using any other suitable mounting arrangement. The bottom panel 806 may form a back side of the device, which can be held by the user during operation of device 800.

To further enable its use as a mobile communications device, device 800 may include various acoustic openings or ports at different locations within enclosure 802 to allow for transmission of acoustic signals to and from device 800. Representatively, enclosure 802 may have formed therein a speaker acoustic port 810, a receiver acoustic port 812 and microphone acoustic ports 816, 818, 820. Although the acoustic ports are illustrated as separate ports, it is contemplated that any one or more of the illustrated ports may be combined into one port such that, for example, the transducers associated with the illustrated receiver or microphone ports may instead share the same port. In one embodiment, the receiver acoustic port 812 is formed within top panel 804 of enclosure 802 and speaker acoustic port 810 is formed within an end portion of sidewall portion 808. It is contemplated, however, that each of these ports may be formed in other portions of enclosure 802, for example, speaker acoustic port 810 may be on the top panel 804 or bottom panel 806 while receiver acoustic port 812 is along the sidewall. Each of these ports may consist of multiple holes clustered together or alternatively a single, large hole as shown.

Each of the speaker acoustic port 810, receiver acoustic port 812 and microphone acoustic ports 816, 818 and 820 may be associated with one or more transducers, which are mounted within enclosure 802. In the case of the microphone acoustic ports 816, 818 and 820, the transducer is an acoustic-to-electric transducer such as a microphone that converts sound into an electrical signal. The microphone may be any type of microphone capable of receiving acoustic energy, for example sound through the associated port, and converting it into an electrical signal. For example, in one embodiment, the microphone may be a micro-electro-mechanical systems (MEMS) microphone, also referred to as a microphone chip or silicon microphone. In this aspect, various features of the microphone such as the pressure-sensitive diaphragm, are etched directly into a silicon chip by MEMS techniques.

Camera 822 may further be mounted to enclosure 802 to capture still and/or video images of objects of interest. Enclosure 802 may further include other input-output devices such as an earphone port (not shown) to receive an earphone plug, docking port 814 and command button 826. Docking port 814 may sometimes be referred to as a dock connector, 30-pin data port connector, input-output port, or bus connector, and may be used as an input-output port (e.g., when connecting device 800 to a mating dock connected to a computer or other electronic device). Command button 826 may be, for example, a menu button or any other device that can be used to supply an input to and/or operate device 800.

A transducer having a magnetically biased electromagnet as previously discussed in reference to FIG. 1A to FIG. 5, may be implemented within communications device 800, for example, by operably connecting the electromagnet 100 and associated coil 120 to the top panel 804 and operably connecting the attractor plate 110 to the bottom panel 806. In this aspect, during operation, the transducer may produce a dynamic force between top panel 804 and bottom panel 806 such that the bottom panel 806 acts as a diaphragm and vibrates thereby generating sound waves which can be emitted to the user to enhance an audio performance of device 800.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, although the transducer assembly (e.g., electromagnet 100 (including coil 120) and attractor plate 110) is described as serving essentially as a "subwoofer," which enhances a performance of existing speakers within the electronic device, the assembly may operate in such a manner that it provides a near full-range response frequency. For example the transducer assembly may output both low and mid-range frequencies. In such embodiments, the transducer assembly may output not only bass range frequencies (e.g., about 20-500 Hz), but also mid-frequencies (e.g., about 500-1500 Hz or higher). The transducer assembly may therefore be combined with other speakers in an electronic device such as a laptop, tablet or handheld computing device, or used instead of other speakers, to enhance or produce sound which can be output from the electronic device to a user without distortion.

Although embodiments described herein have generally been discussed with respect to standalone electronic devices (many of which may be portable), it should be appreciated that the embodiments disclosed herein may be applied in a variety of other fashions. For example, the audio transducer described herein may be integrated into conventional speakers and operate with the woofers and tweeters of the conventional speaker. Likewise, an audio transducer of the type disclosed herein may be incorporated into a seat or chair as part of a home theater experience. The audio transducer may vibrate not only the chair but the person sitting in the chair under certain circumstances, thereby providing not only audible but also tactile feedback if desired. As still another example, the audio transducer may be combined with a capacitive or touch-based input so that motions of a user's hands on a device enclosure may act to increase or decrease the output of the audio transducer. The description is thus to be regarded as illustrative instead of limiting.

What is claimed is:

1. An electronic device comprising:

an enclosure having a top panel and a bottom panel;

an electromagnet mounted within the enclosure, the electromagnet having a core portion attached to the top panel and a coil connected to the core portion;

an attractor plate attached to the bottom panel, the attractor plate forming part of a magnetic circuit of the electromagnet such that input of an electrical audio signal to the electromagnet causes the bottom panel to move and produce an audible sound; and a permanent magnet attached to the core portion, the permanent magnet made of a different material than the core portion and having a magnetic pole that faces the attractor plate such that the permanent magnet creates a bias in the magnetic circuit that modifies a distortion in the audible sound.

2. The electronic device of claim 1 wherein the distortion is caused by a rectification of the electrical audio signal and biasing of the magnetic circuit allows the electrical audio signal to be recreated as a dynamic force without the rectification.

3. The electronic device of claim 1 wherein the core portion comprises a coil support arm around which the coil is positioned, a first side arm and a second side arm, and wherein the permanent magnet comprises a first magnet and a second magnet, each of the first magnet and the second magnet positioned at ends of the first side arm and the second side arm, respectively, and having the same magnetic poles facing the attractor plate.

4. The electronic device of claim 1 wherein the core portion comprises a base portion having a coil support arm around which the coil is positioned, a first side arm and a second side arm extending therefrom.

5. The electronic device of claim 4 wherein the permanent magnet comprises a first magnet and a second magnet, each of the first magnet and the second magnet positioned at ends of the first side arm and the second side arm, respectively, and facing the attractor plate.

6. The electronic device of claim 4 wherein the permanent magnet comprises a first magnet and a second magnet, each of the first magnet and the second magnet positioned at sides of the first side arm and the second side arm, respectively.

7. The electronic device of claim 1 further comprising:

a resilient spacer positioned within the magnetic circuit, between the attractor plate and core portion.

8. The electronic device of claim 7 wherein the resilient spacer comprises a ferromagnetic material to improve an efficiency of the magnetic circuit.

9. The electronic device of claim 1 wherein the attractor plate is fixedly attached to a side of the bottom panel facing the electromagnet.

10. The electronic device of claim 1 wherein the attractor plate comprises a ferromagnetic material.

11. An electronic audio system comprising:

an enclosure having a first panel operably connected to a second panel;

a transducer mounted within the enclosure, the transducer comprising:

an electromagnet having a core portion mounted to the first panel and a coil positioned around the core portion;

an attractor plate mounted to a side of the second panel facing the first panel, the attractor plate forming part of a magnetic circuit produced by the electromagnet upon input of an electrical audio signal; and a permanent magnet mounted to the core portion, the permanent magnet made of a different material than the core portion and configured to bias the magnetic circuit produced by the electromagnet such that a dynamic force between the first panel and the second panel is proportional to the electrical audio signal and results in an audible sound output; and a processor in electrical communication with the transducer and coupled to a memory to execute an operating system program.

12. The electronic audio system of claim 11 further comprising:

a resilient spacer positioned within a gap between the electromagnet and the attractor plate.

13. The electronic audio system of claim 11 wherein the transducer, the memory and the processor are contained within the enclosure.

14. The electronic audio system of claim 11 wherein the dynamic force between the first panel and the second panel causes the second panel to move while the first panel having the electromagnet attached thereto remains substantially stationary.

15. The electronic audio system of claim 11 wherein the dynamic force causes one of the first panel and the second panel to produce the audible sound output, and the audible sound output is at a frequency below 1 kilohertz such that it enhances a bass response of a speaker within the audio system.

16. A method of outputting sound from an electronic device comprising:

generating an audible sound output by producing a dynamic force between a first panel and a second panel of an enclosure of an electronic device, wherein producing the dynamic force comprises applying an electrical audio signal to an electromagnet having a core portion and a coil attached to the first panel so as to create a magnetic circuit which attracts the second panel to the first panel; and magnetically biasing the magnetic circuit so that 1) the dynamic force is proportional to the electrical audio signal and 2) the audible sound output enhances a bass response of the electronic device.

17. The method of claim 16 wherein the magnetic circuit is biased by a permanent magnet positioned within the magnetic circuit so as to increase a magnetic force between the electromagnet and the second panel.

18. The method of claim 16 wherein the magnetic circuit is biased using a direct current.

19. The method of claim 16 wherein biasing the magnetic circuit modifies a rectification of the electrical audio signal so that the sound can be recreated from the electrical audio signal without distortion.

20. The method of claim 16 further comprising:

an attractor plate attached to a side of the second panel facing the electromagnet such that the attractor plate is within the magnetic circuit and an attractive force between the attractor plate and the electromagnet pulls the second panel toward the first panel.

* * * * *